United States Patent [19]

Korkemeier

[11] Patent Number: 4,648,243

[45] Date of Patent: Mar. 10, 1987

[54] HOLLOW CERAMIC BODY

[75] Inventor: Hans Korkemeier, Weissach, Fed. Rep. of Germany

[73] Assignee: Dr. Ing. h.c.F. Porsche AG, Fed. Rep. of Germany

[21] Appl. No.: 684,866

[22] Filed: Dec. 21, 1984

[30] Foreign Application Priority Data

Dec. 22, 1983 [DE] Fed. Rep. of Germany ..... 3346394

[51] Int. Cl.[4] ..... F01N 7/18

[52] U.S. Cl. ..... 60/272; 138/111; 138/145; 138/172; 164/100

[58] Field of Search ..... 29/527.3, 527.6; 164/100; 138/111, 145, 172, 97, 99; 181/245; 264/36; 60/272, 282; 123/193 H

[56] References Cited

U.S. PATENT DOCUMENTS

| | | | |
|---|---|---|---|
| 1,954,638 | 4/1934 | Loeffler | 138/145 X |
| 2,635,329 | 4/1953 | DeForest et al. | 264/36 X |
| 4,346,556 | 8/1982 | Rice et al. | 138/145 X |

FOREIGN PATENT DOCUMENTS

| | | |
|---|---|---|
| 2549256 | 5/1977 | Fed. Rep. of Germany . |
| 2750290 | 5/1979 | Fed. Rep. of Germany . |

OTHER PUBLICATIONS

Hackh's, *Chemical Dictionary*, Grant, 3rd Ed., 1944, p. 924.

*Primary Examiner*—Stephen Marcus
*Assistant Examiner*—Mark Thronson
*Attorney, Agent, or Firm*—Barnes & Thornburg

[57] ABSTRACT

A ceramic body for use as a gas conduction channel or duct and preferably used to define an exhaust channel in a cylinder head of an internal combustion engine, where the cylinder head is cast around the ceramic body. The ceramic body is provided with a thickening or external layer over at least a part of its outer surface. This external layer adds stability and strength to the ceramic body and allows it to withstand the pressures occurring during the casting of the cylinder head. The thickening or external layer is formed from a pressure resistant material and may be applied to a depression in the ceramic body or into the space between two parallel ceramic bodies to provide the required strength and stability.

12 Claims, 5 Drawing Figures

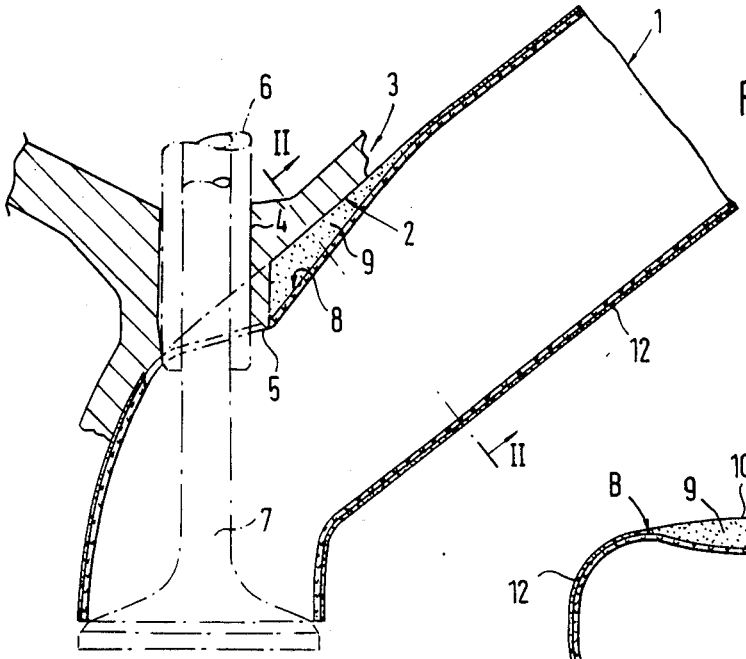
Fig.1
Fig.2
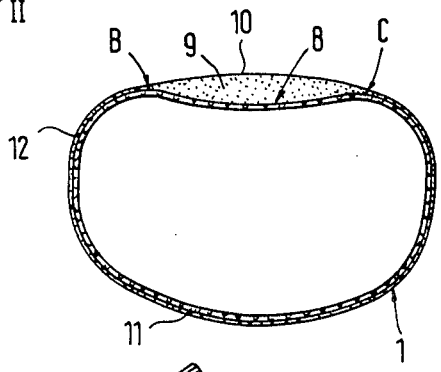
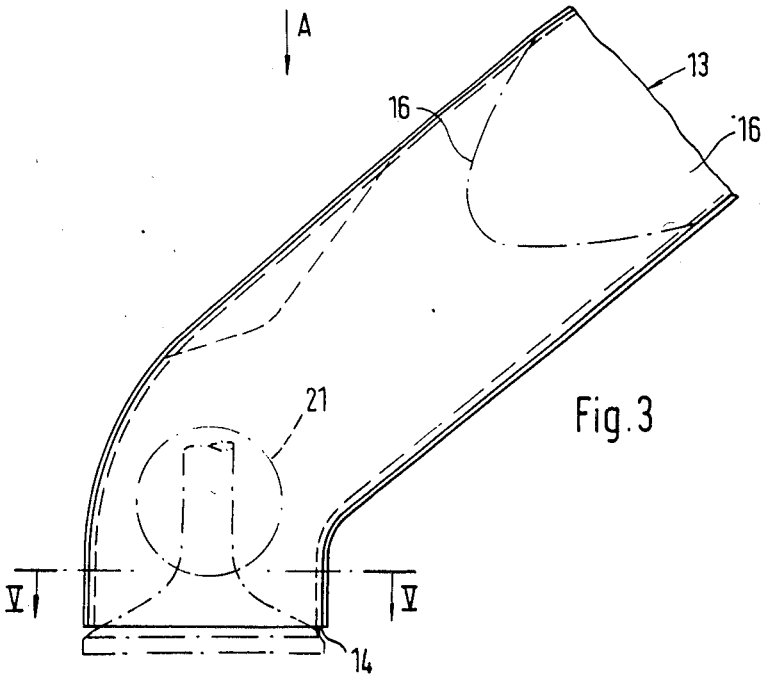
Fig.3

HOLLOW CERAMIC BODY

BACKGROUND OF THE INVENTION

This invention relates to hollow, pipe-like or tubular ceramic bodies used as gas conducting channels and particularly to ceramic bodies used as exhaust ducts of a cylinder head of an internal combustion engine. More particularly, the present invention relates to a means of strengthening the ceramic bodies by the application of a pressure resistant coating or layer.

Ceramic bodies of this type are included in a cylinder head when the cylinder head is cast from a material such as an aluminum alloy. Relatively high structural loads are exerted on the ceramic bodies during the casting operation due to casting pressures, shrinkage pressures, and congealing pressures. These pressures require a ceramic body of this type to exhibit a great deal of structural integrity which generally necessitates that their transverse cross sectional profile be either circular or oval.

Such a profile is difficult to maintain over the entire length of an exhaust duct of the cylinder head because the duct must be contracted in the area of a bore for a valve introduction (German Publishing Examined Patent Application No. 2,750,290) to form a throat or depression. Such a contraction or depression must be compensated for in order to avoid a decrease in cross sectional area which would hinder the gas flow. This compensation to maintain a constant cross sectional area generally requires that the transverse cross sectional profile of the exhaust duct become kidney shaped. This kidney shaped profile is inherently weaker with respect to externally inwardly applied forces than a circular or oval profile. Tests have shown that a ceramic exhaust duct which has a contraction or depression and a resulting kidney shaped profile can not withstand the loads experienced during the casting of the cylinder head.

One object of the present invention is to provide a hollow pipe-like or tubular ceramic body which, on the one hand is able to conform to the structural requirement in a cylinder head of an engine, and on the other hand can withstand the loads imposed during the casting of that cylinder head.

According to the present invention, a tubular ceramic body is provided which has a thickened portion or external layer applied to at least the contraction or depression. This thickened portion or external layer consists of a pressure resistant material which fills in the depression and gives the ceramic body the strength needed to withstand the pressures occurring during the casting of the cylinder head.

The pressure resistant material for the thickened portion or external layer is preferably Zirconic oxide wherein the Zirconic oxide may be applied by utilizing a conventional plasma spraying means such that at least a portion of the outer surface of the ceramic body is coated. This layer exhibits a rough surface which provides good casting properties for the ceramic body and also improves its heat insulation qualitites against the cylinder head. Where the ceramic body includes a single duct which is bifurcated into two duct sections, the pressure resistant material may be applied as support between the duct sections such that the ceramic body can, without damage, withstand the pressures occurring during the casting of the cylinder head.

Further objects, features, and advantages of the present invention will become more apparent from the following description when taken with the accompanying drawings which show, for purpose of illustration only, an embodiment in accordance with the present invention.

BRIEF DESCRIPTION OF THE DRAWINGS

FIG. 1 is a transverse sectional view through a ceramic body;

FIG. 2 is a sectional view along the lines II—II of FIG. 1;

FIG. 3 is a side view of another embodiment of a ceramic body;

DETAILED DESCRIPTION OF THE DRAWINGS

Figure 4:
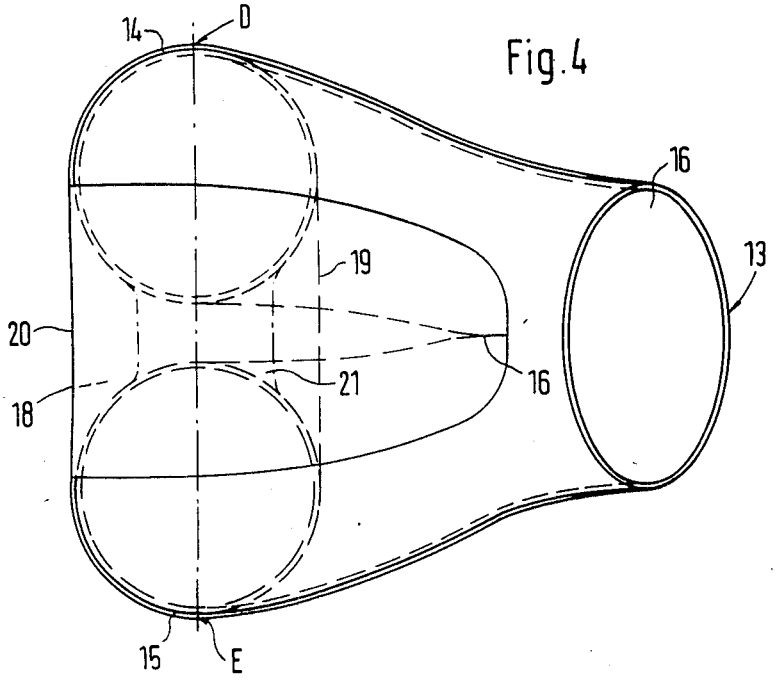
FIG. 4 is a top plan view looking in the direction of arrow A of FIG. 3.

A hollow, pipe-like ceramic body 1 ("Tialit" ceramic) as shown in FIG. 1 which defines a channel for an exhaust pipe 2 for carrying hot gases through a cylinder head 3 consisting of, for example, an aluminum cast alloy and shon only inpart. The ceramic body 1 exhibits an essentially constant wall thickness which is obtained during the manufacturing process.

The cylinder head 3 includes a vertical bore 4 which provides for a can-like protrusion 5 protruding into the exhaust pipe 2. A guiding device 6 for a valve 7 is pressed into the bore 4. The valve 7 controls the gas flow within the ceramic body 1.

In the area of bore 4 or next to it, the ceramic body 1 exhibits a throat 8 which results from the connection of the ceramic body 1 to the bore 4 or protrusion 5.

Throat 8 is filled out with a thickening 9 which has an outermost surface 10 which is convexly shaped for stability reasons. Thickening 9 outside of throat 8 in section B-C of ceramic body 1 is formed such that outermost surface 10 is continuous with the overall shape of the ceramic body 1. The ceramic body thereby exhibits a convex shape in the area of the thickening 9 which is similar to the shape of the ceramic body 1 at its opposite side 11.

The thickening 9 consists of the material Zirconic oxide which is applied by plasma spraying means. The ceramic body 1 is sprayed at its outer surface with the Zirconic oxide to provide a layer 12 of said material. The thickening may be either pure zirconic oxide or consist essentially of zirconic oxide.

Figure 5:
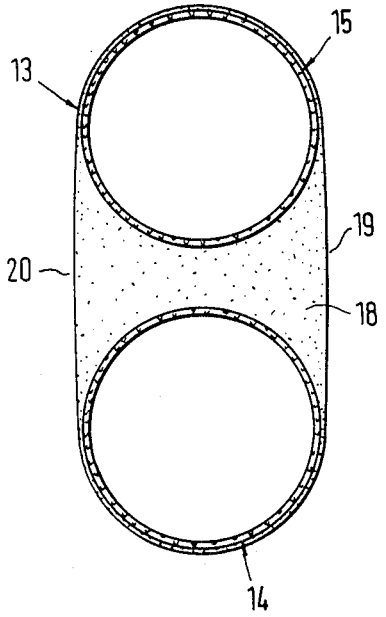
FIG. 5 is a sectional view along the line V—V of FIG. 3.

In FIGS. 3, 4 and 5, the ceramic body 13 includes two pipe or duct sections 14, 15 which extend parallel to each other in a spaced apart relation and come together at 16 into a single bifurcated duct piece 17. Both duct sections 14, 15 are used to define channels for exhaust pipes of a cylinder head which is not shown here, the cylinder head including two exhaust valves per cylinder. To prevent any structural damage from the forces exerted during the casting of the cylinder head on points D and E of the ceramic body 13, a thickening 18 is provided between the pipe sections 14, 15 which provides a support function. The thickening 18 fills the space between the two duct sections 14, 15 as shown in FIG. 5 such that the outermost surfaces 19, 20 of the thickening 18 are raised slightly to form a smooth transition into the shape of the duct sections 14, 15. The thickening 18 extends over the entire height and length of the duct sections 14, 15.

It is also feasible to provide for a thickening 21 only as a local support between the duct sections 14, 15 which is schematically depicted in FIGS. 3 and 4.

Although the invention has been described in detail with reference to certain preferred embodiments and specific examples, variations and modifications exist within the scope and spirit of the invention as described and defined in the following claims.

What is claimed is:

1. A hollow, tubular ceramic gas-conducting channel of a cylinder head in an internal combustion engine including, at least one lateral depression, said depression being filled with a pressure-resistent thickening for optimizing the strength of the ceramic channel.

2. The ceramic channel of claim 1, wherein the thickening includes an outermost surface, and wherein this outermost surface is convex shaped.

3. The ceramic channel of claim 2, wherein the outermost surface of the thickening is continuous with the profile of the outer surface of the tubular channel .

4. The ceramic channel of claim 3, wherein the thickening consists of Zirconic oxide.

5. The ceramic channel of claim 4, wherein the entire outer surface of the tubular channel is layered with Zirconic oxide.

6. Ther ceramic channel of claim 1, wherein the tubular channel includes two duct sections having a space therebetween, and wherein the pressure-resistant layer fills in at least a portion of the space between the said two duct sections.

7. The ceramic channel of claim 6, wherein the thickening fills in the entire space between the duct sections.

8. The ceramic channel of claim 6, wherein the thickening fills in only a portion of the space between the duct sections.

9. The ceramic channel of claim 1, wherein the pressure-resistant thickening provides sufficient rigidity and strength to withstand pressures occurring during casting of the cylinder head around the ceramic channel.

10. The ceramic channel of claim 9, wherein the pressure-resistant thickening has a sufficiently low thermal conductivity to provide an insulation function.

11. The ceramic channel of claim 1, wherein the pressure-resistant thickening is formed from a material which consists essentially of Zirconic oxide.

12. A ceramic channel according to claim 1, wherein said depression is completely filled with said pressure resistent thickening.

* * * * *